United States Patent [19]

Tholander

[11] Patent Number: 4,848,416

[45] Date of Patent: Jul. 18, 1989

[54] WEFT YARN INSERTION NOZZLE DEVICE

[75] Inventor: Lars H. G. Tholander, Huskvarna, Sweden

[73] Assignee: Aktiebolaget IRO, Ulricehamn, Sweden

[21] Appl. No.: 111,789

[22] PCT Filed: Jan. 2, 1987

[86] PCT No.: PCT/EP87/00001

§ 371 Date: Aug. 28, 1987

§ 102(e) Date: Aug. 28, 1987

[87] PCT Pub. No.: WO87/04199

PCT Pub. Date: Jul. 16, 1987

[30] Foreign Application Priority Data

Jan. 3, 1986 [SE] Sweden ..... 86 00031-2

[51] Int. Cl.[4] ..... D03D 47/30

[52] U.S. Cl. ..... 139/435; 251/129.21

[58] Field of Search ..... 139/435; 251/12, 30.05, 251/129.21

[56] References Cited

U.S. PATENT DOCUMENTS

| | | | |
|---|---|---|---|
| 3,519,030 | 7/1970 | Vermeulen | 139/435 |
| 3,628,767 | 12/1971 | Lombard et al. | 251/129.21 |
| 4,212,330 | 6/1980 | Von Donk . | |
| 4,441,687 | 4/1984 | Pauliukonis | 251/129.21 |
| 4,466,468 | 8/1984 | Brouwer . | |
| 4,471,818 | 9/1984 | Brouwer et al. | 139/435 |
| 4,625,770 | 12/1986 | Ishikawa | 139/435 |

FOREIGN PATENT DOCUMENTS

| | | | |
|---|---|---|---|
| 903156 | 2/1986 | Belgium . | |
| 28442 | 2/1987 | Japan | 139/435 |

*Primary Examiner*—Henry S. Jaudon

*Attorney, Agent, or Firm*—Flynn, Thiel, Boutell & Tanis

[57] ABSTRACT

A weft yarn insertion nozzle device for a jet weaving machine, comprises a supply, an outlet nozzle, a conduit connecting the supply and the outlet nozzle and a valve unit. The valve unit comprises a displaceable, soft-magnetic valve body and a coil for generating a magnetic field extending through the valve body, wherein the valve body is arranged within the conduit such that the flowing of pressurized medium therethrough exerts a force on the valve body which is opposite to the force as generated by the magnetic field.

13 Claims, 4 Drawing Sheets

WEFT YARN INSERTION NOZZLE DEVICE

FIELD OF THE INVENTION

The present invention relates to a nozzle device for inserting of a weft yarn through the shed of a weaving machine by means of a jet of pressurized medium.

BACKGROUND OF THE INVENTION

In jet weaving machines the weft yarn is inserted through the shed by means of a pulse-like jet of fluid normally air. The necessary jet of pressurized medium is generated by a nozzle device, which in conventional jet weaving machines comprises a nozzle mounted on a sley in the weaving machine which is supplied by a pressure medium from a valve device positioned stationarily in the weaving machine, which is controlled by an electric control unit operating the valve device in synchronism with the operation of the weaving machine. In addition to a so-called main nozzle, which is arranged at the insertion side of the weft yarn in the weaving machine outside the shed, so-called relay-nozzles are arranged on the sley in the shed at equal distances from one another, which relay nozzles are also connected to valve devices which are stationarily arranged in the weaving machine and controlled by the electric control unit thereof. The electric control unit of the weaving machine successively operates the main nozzle and the respective relay nozzles during each pick or weft yarn shot for bringing the weft yarn to the arrival end in the shed. The volume of pressurized medium contained in the ducts between the respective valves and the respective nozzles of these conventional nozzle devices having separate valves and nozzles results in considerable response times which in turn negatively affect the control behaviour of the overall system. Another type of nozzle device having an integrated valve is known from U.S. Pat. No. 4,466,468. This prior art nozzle device comprises a supply for pressurized medium, an outlet nozzle in the form of a passageway through which the weft yarn is guided, a conduit connecting the supply and the outlet nozzle and a valve unit arranged between the supply and the outlet nozzle. The conduit includes an outer storage chamber which, in the open position of the valve unit, is in connection with a cone-shaped duct terminating at the nozzle passageway. The cone-shaped duct and the outer chamber are separated by a rounded edge which is in contact with a flexible diaphragm extending in the radial direction of the device which diaphragm and edge together form the valve unit. The position of the diaphragm is controlled by the pressure of a control air which is fed to the prior art nozzle device by separate solenoids or rotary spool valves. When reducing the pressure of the control air the diaphragm is bent away from the rounded edge so that the pressurized medium flows from the storage chamber to the outlet nozzle. The dynamic control behaviour of this prior art nozzle device is subject to inherent limitations caused by the two-stage valve design necessitating a servo-valve for controlling the operation of the main valve in the form of the diaphragm. In other words, the overall response time of this prior art nozzle device is necessarily longer than the sum of the response times of the servo-valve unit and of the nozzle device itself. Moreover, this prior art nozzle device has a complicated mechanical design caused by the necessity of a diaphragm and a conduit in the form of an outer storage chamber and a cone-shaped duct terminating at the outlet nozzle.

In view of the above prior art nozzle devices, the present invention is based on the object of achieving a nozzle device having a favourable dynamic behaviour although having a relatively simple design.

This object is achieved by a nozzle device in accordance with the claims hereof.

In accordance with the present invention, the valve unit comprises a displaceable soft-magnetic valve body and a coil for generating a magnetic field extending through the soft-magnetic valve body when feeding an actuation current to the coil. The displaceable, soft-magnetic valve body is arranged within the conduit such that the flowing of pressurized medium through the conduit from the supply to the outlet nozzle exerts a force on the valve body having an opposite direction when compared to the direction of the force as generated by the magnetic field. In a preferred embodiment the magnetic field generated by the coil when feeding the actuation current thereto moves the soft-magnetic valve body in its open position allowing a flowing of the pressurized medium from the supply through the conduit to the outlet nozzle. When terminating the actuation current, the pressurized medium flowing along the valve body urges it in its closed position due to frictional forces between the flowing pressurized medium and the valve body itself. When changing the flow direction of the pressurized medium with regard to the direction of movement of the valve body from its open to its closed position, the flowing of pressurized medium can also be used for opening the valve body while closing it due to the magnetic field as generated by the coil when feeding an actuation current thereto.

The valve body preferably has an annular shape, wherein the inner surface of the valve body is in sealing, sliding contact with respect to a cylindric inner wall of the conduit. Although an annular design of the valve body and a cylindric form of the inner wall are preferable for constructional reasons, other cross-sections of the valve body and of the inner wall may also be chosen.

The conduit has an annular portion and surrounds the cylindric, inner wall and the valve body and comprises a radially inwardly extending portion interconnecting the annular portion and the outlet nozzle. Furthermore, the valve body is displaceable in its axial direction for sealing against an essentially radial abutment portion so as to interrupt the radially inwardly extending portion of the conduit. This particular advantage caused by this particular design of the conduit permits a guiding of the pressurized medium along the outer surface of the valve body parallel to its direction of movement in its closed position while it renders possible to manufacture the parts of the nozzle body by machining them.

The valve body has radially extending grooves at its outer surface. These radial grooves increase the friction between the pressurized medium flowing along the outer surface of the valve body and the valve body itself. Hence, the force urging the valve body in its closed position is desirably increased for shortening the closing time of the valve upon terminating the actuation current fed to the coil of the nozzle device.

The valve body has radial bores defining a residual flow of pressurized medium in the closed position of the valve body. The residual flow keeps the resting weft yarn under control.

The valve body preferably consists of an annular portion of soft-magnetic material and a shoe made of elastomeric material. The shoe of elastomeric material forms a sealing surface between the valve body itself and the radial abutment portion.

BRIEF DESCRIPTION OF THE DRAWINGS

Hereinafter, preferred embodiments of the nozzle device in accordance with the present invention will be described with reference to the attached drawings, in which.

DETAILED DESCRIPTION

Figure 1:
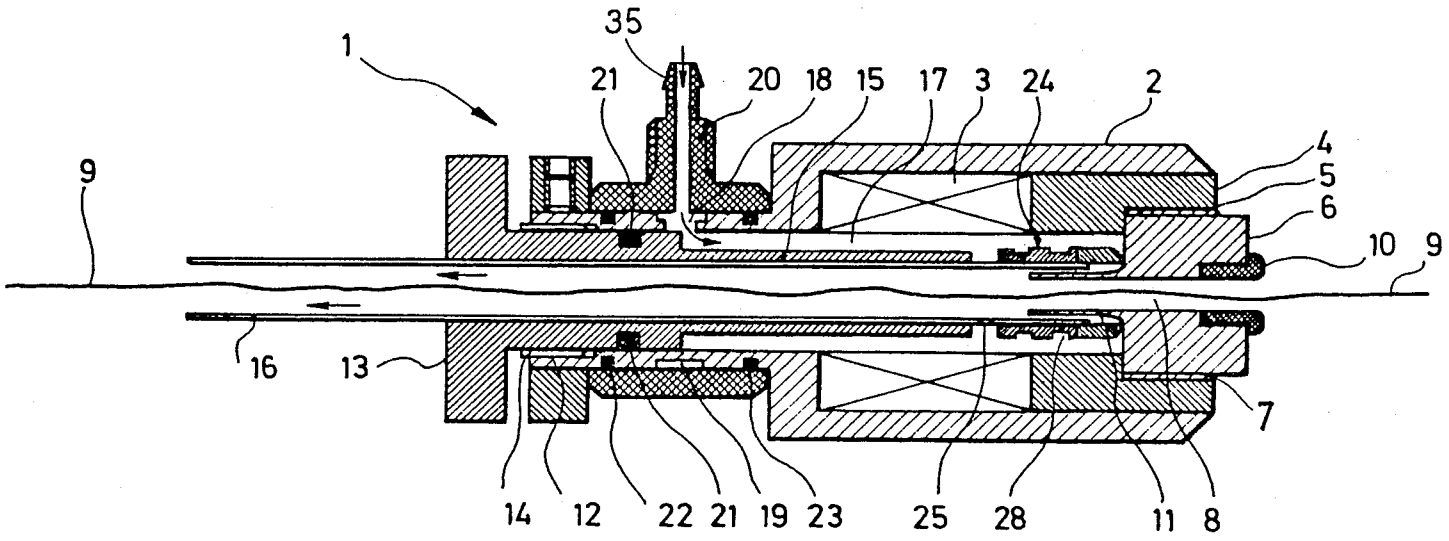
FIG. 1 shows a cross-sectional representation of a first embodiment of the nozzle device in accordance with the present invention wherein a valve unit is in its closed position.
Figure 1A:
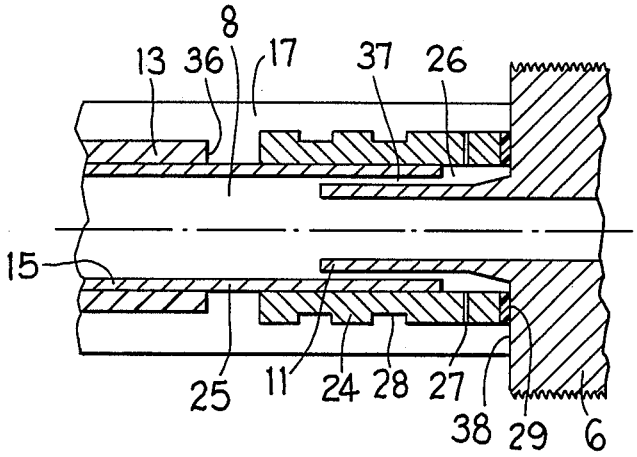
FIG. 1A is a fragmentary enlargement of a portion of FIG. 1.

As shown in FIG. 1, a nozzle device 1 in the form of a so-called main nozzle comprises a housing 2 which can be fixedly mounted to a sley in a weaving machine (not shown here). An electro-magnetic coil 3 is located within the housing 2 and is kept in its axial position by means of an annular mounting body 4 which is inserted in the housing 2 under press fit. The inner surface of the mounting body 4 has partially the form of an inner thread 5 engaging an outer thread 7 of an abutment portion 6. The abutment portion 6 has a central yarn passage 8 for guiding the yarn 9 through the main nozzle device. The abutment portion 6 is screwed into the mounting body 4. A yarn guiding eyelet 10 consisting of ceramic material is attached to the outer central orifice of the abutment portion 6. The abutment portion 6 has an axial extention at its inner central orifice in the form of a short nozzle tube 11 having thin walls. At the left-hand side of the main nozzle device 1 in accordance with FIG. 1, the housing 2 is equipped with an inner thread 12. A longitudinal passageway body 13 including an elongated tube-like member 15 is equipped with an outer thread 14 by means of which the longitudinal passageway body 13 is screwed into the inner thread 12 of the housing 2 in a position which is axially adjustable relative to the abutment portion 6. The tube-like member 15 forms has a long tube extension 16 at the left-hand side of the longitudinal passageway body 13 in accordance with FIG. 1.

The inner diameter of an inner portion of the housing 2, the coil 3 and the mounting body 4 is slightly greater than the outer diameter of the tube-like member 15 of the longitudinal passageway 13 so that an annular-shaped conduit 17 is defined between these parts. Compressed air is supplied to the annular-shaped conduit 17 through a plurality of radial holes 18 which are connected to an outer annular recess 19 formed by an annular groove provided in the outer surface of the housing 2. A supply of compressed air formed by an air compressor (not shown in the drawings) is in connection with the annular recess 19 by means of an inlet opening 35 formed in a pressure air connection member 20. The pressure air connection member has an inner bore 21 corresponding to the outer diameter of the housing 2 in the range of the connection member 20. A pressure-tight sealing between the connection member 20 and the housing 2 and the passageway member 13 is created by three O-rings 21, 22 and 23.

The member 15, at its inner (rightward) end has a tube portion 25 which projects outwardly beyond the end wall or shoulder 36 of the body 13. This tube part 25 is radially outwardly spaced from but axially overlaps the tube 11 to define a discharge nozzle 37 therebetween. However, the free end of tube part 25 is spaced from the shoulder or wall 38 to define an annular radially-directed passage 26 for selectively permitting communication between passage 17 and nozzle 37 as explained below.

An annular-shaped valve body 24 consisting of a soft-magnetic material is in sealing, sliding contact with the cylindric outer surface of the tube part 25 of the tube-like member 15. The valve body 24 is displaceable along the axial direction of the tube-like member 15. In a first position (FIG. 2) of the valve body 24 which corresponds to the open position of the valve it abuts against the shoulder 36. In this position of the valve body 24 the compressed air flows from the connection member 20 via the annular-shaped conduit 17 through the radially inwardly extending passage 26 (see FIG. 2), and thence through nozzle 37 into the yarn passage 8 of the nozzle device 1.

The valve body 24 is in this first position when the electro-magnetic coil 3 is supplied with an actuation current generated by an electric control unit (not shown here) working in synchronism with the weaving machine. The valve body 24 is in its first position when the weft yarn insertion is carried out. When moving the valve body from its closed position in its first open position, the yarn being at rest in the previous moment, will be quickly accelerated by the compressed air blowing the weft yarn through the shed of the weaving machine.

In the other working position of the valve body 24 (that is, its closed non-energized position) which is shown in FIG. 1, the other end of valve body 24 rests against the shoulder 38 of the abutment portion 6. The valve body 24 has some fine radial openings 27 having a diameter in the range of 0.3 mm. These fine radial bores define therethrough a residual flow of pressurized medium in the closed position of the valve body 24 for keeping the resting yarn under control. The valve body 24 is in this second position when no actuation current is fed to the electro-magnetic coil 3.

In other words, the soft-magnetic valve body 24 is kept in its open, first position by the magnetic force exerted upon it by the magnetic field generated by the coil 3 when feeding an actuation current thereto. When switching-off the actuation current, the flowing of the pressurized medium along the outer surface of the valve body 24 causes frictional forces thereon for shifting the valve body 24 into its closed position. For shortening the closing time the valve body 24 is equipped with radially extending grooves 28 which increase the closing force imposed on the valve body by the pressurized medium.

The valve body is equipped with a shoe 29 consisting of elastomeric material which is located at the end of the valve body 24 facing the abutment portion 6. This shoe enhances the sealing of the valve body 24 with regard to the abutment portion 6.

Preferrably, the valve body 24, the housing 2, the mounting body 4 and the longitudinal passageway body 13 are made of soft-magnetic material whereas the abutment portion 6 consists of non-soft-magnetic material.

Figure 2:
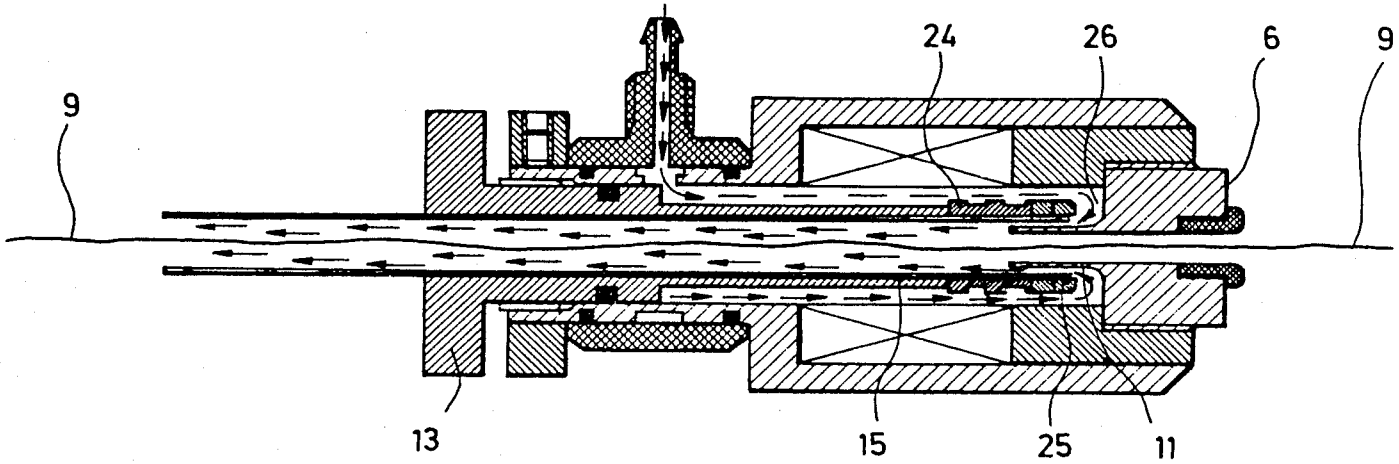
FIG. 2 is a cross-sectional representation of the embodiment in accordance with FIG. 1, wherein the valve unit is in its open position.
Figure 3:
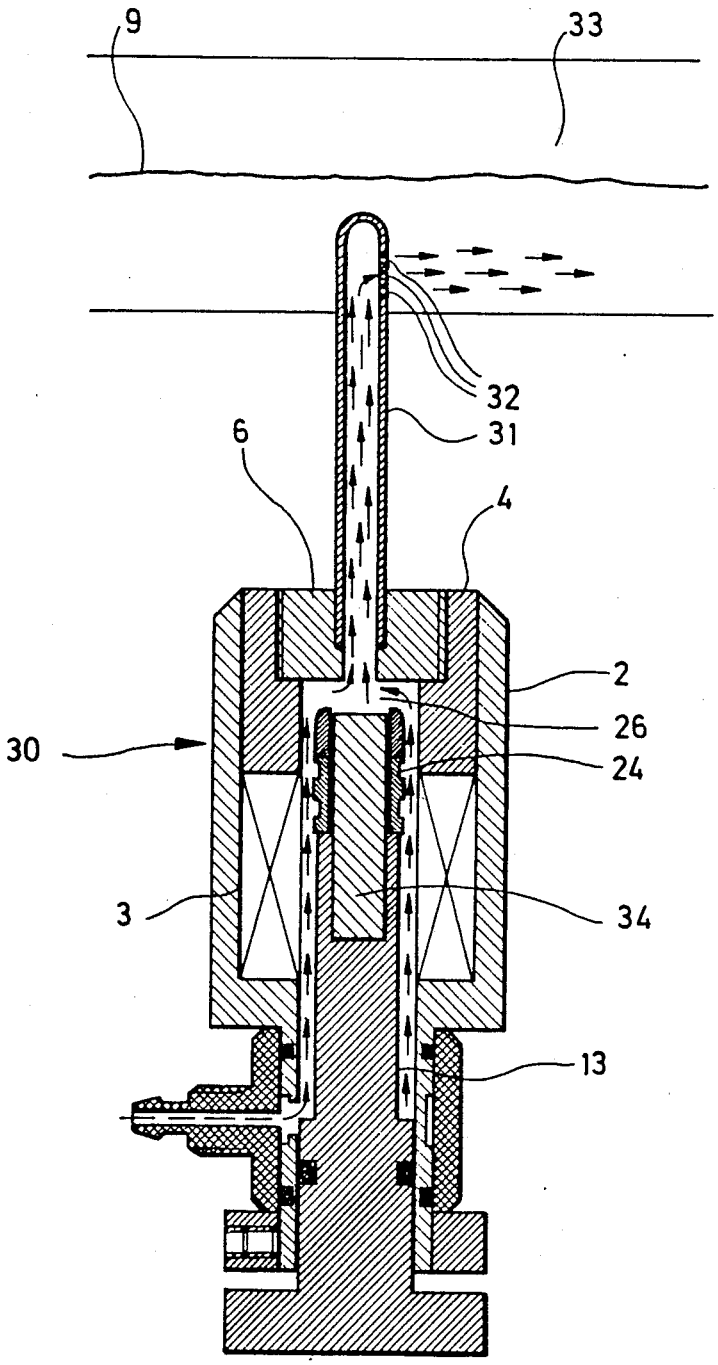
FIG. 3 shows a cross-sectional representation of a second embodiment of the nozzle device in accordance with the present invention.

FIG. 3 shows a second embodiment of a nozzle device in accordance with the present invention which has the form of a relay nozzle 30. The relay nozzle 30 has essentially the same design when compared to the main nozzle device 1 as shown in FIGS. 1 and 2. Therefore, only those parts will be described hereinafter which differ in design and function when compared to the parts of the embodiment in accordance with FIGS. 1 and 2.

The relay nozzle 30 does not have a yarn passage 8 but has instead thereof a tube-shaped part 31 extending from the abutment portion 6. The abutment portion 6 is not equipped with a tube 11 at its inner orifice. The free end of the tube-shaped part 31 is provided with a plurality of fine-holes 32 forming a group of outlet nozzles. In the open position of the valve body 24 the pressure medium in the form of pressurized air flows from the fluid supply via the annular-shaped conduit through the essential radially inwardly extending passage 26 of the conduit through the tube-shaped part 31 to the fine holes 32. The air jet generated at the fine holes 32 supports the feeding of the yarn 9 through the shed 33 of the weaving machine and thus carries the yarn 9 to the arrival end of the shed.

The interior of the longitudinal body 30 is filled by a filler-member 34 consisting of a non-soft-magnetic material.

The nozzle device in accordance with the present invention renders it possible to minimize the "dead" volume of air or medium between the nozzle and the valve when compared to prior art devices having separate, non-integrated valves. When compared to the prior art nozzle device having an integrated valve the present invention not only teaches a simplified design of the nozzle device, but also how to achieve a shortened response time thereof by avoiding servo-valves controlling the main valve.

The valve body 24 can have a very short stroke length in the range of 0.3–0.4 mm resulting in a further shortening of the nozzle response time.

The valve body is brought in its non-actuated position by the flow of pressurized medium which further contributes to the simplicity of the design and to the shortening of the response time of the device.

The short response time of the nozzle device in accordance with the present invention enhances the control behaviour of the weft yarn insertion procedure and avoids an over-stretching of the yarn at the beginning and at the end of a pick.

The elimination of the "dead" volume and the reduction of the response time permits a saving of consumed pressurized medium.

When utilizing the nozzle device in accordance with the present invention in a multi-colour weaving machine only one hose for compressed air is required for the supply for the respective nozzles, which simplifies the overall design of the weaving machine.

I claim:

1. In a weft yarn insertion nozzle device for inserting a weft yarn through a shed of a weaving machine by means of a jet of pressurized medium, said device including a supply passage for said pressurized medium, an outlet nozzle means for discharging a stream of pressurized medium into a yarn passage for controlling movement of the yarn therealong, conduit means defining a flow passage connecting said supply passage and said outlet nozzle means, and a valve unit arranged between said supply passage and said outlet nozzle means for controlling flow of medium into said yarn passage, the improvement comprising:

said valve unit comprising a displaceable, soft-magnetic valve body movable between open and closed positions, and an electric coil for generating a magnetic field extending through said soft-magnetic valve body when feeding an actuation current to said coil for moving said valve body into one said position;

said displaceable, soft-magnetic valve body being arranged within said conduit means such that the flowing of pressurized medium through the conduit means from the supply passage to the outlet nozzle means exerts a force on said valve body which is opposite to the force as generated by said magnetic field so as to urge said valve body into the other said position; and said valve body having an annular-shape and having an inner annular surface in sealing, sliding contact with a cylindric inner wall defining part of said conduit means.

2. Nozzle device as claimed in claim 1, wherein:

said conduit means defines an annular passage portion which externally surrounds said cylindric inner wall and said valve body, and a radially inwardly extending passage portion interconnecting said annular passage portion and said outlet nozzle means, and said valve body is displaceable in its axial direction for sealing against an essentially radial abutment portion so as to close off said radially inwardly extending passage portion of said conduit.

3. Nozzle device as claimed in claim 1, wherein said valve body has radially inwardly extending grooves at its outer surface.

4. Nozzle device as claimed in claim 1, wherein said valve body consists of an annular portion of soft-magnetic material and of a shoe of elastomeric material for sealing engaging a fixed seat when the valve body is in said closed position.

5. In a weft yarn insertion nozzle device for inserting a weft yarn through a shed of a weaving machine by means of a jet of pressurized medium, said device including a supply passage for said pressurized medium, an outlet nozzle means for discharging a stream of pressurized medium into a yarn passage for controlling movement of the yarn therealong, conduit means defining a flow passage connecting said supply passage and said outlet nozzle means, and a valve unit arranged between said supply passage and said outlet nozzle means for controlling flow of medium into said yarn passage, the improvement comprising:

said valve unit comprising a displaceable, soft-magnetic valve body movable between open and closed positions, and an electric coil for generating a magnetic field extending through said soft-magnetic valve body when feeding an actuation current to said coil for moving said valve body into one said position;

said displaceable, soft-magnetic valve body being arranged within said conduit means such that the flowing of pressurized medium through the conduit means from the supply passage to the outlet nozzle means exerts a force on said valve body which is opposite to the force as generated by said magnetic field so as to urge said valve body into the other said position; and said valve body having a small radial bore therethrough for defining a residual flow of pressurized medium in the closed position of the valve body.

6. In a weft yarn insertion nozzle device for inserting a weft yarn through a yarn passage of a weaving machine by means of a jet of pressurized fluid medium, the improvement comprising:

elongate conduit means including concentric inner and outer shaft-like members which define an axially elongate annular supply passage therebetween, said conduit means having an inlet opening therein in communication with one end of said supply passage, said inlet opening being connectable to a supply of pressurized fluid medium;

Nozzle means fixedly related to said conduit means and disposed in substantially coaxial alignment with said supply passage, said nozzle means defining therethrough a discharge passage terminating at one end in a discharge orifice which discharges the fluid medium directly into the yarn passage, said discharge passage at its other end having an inlet which is disposed in the vicinity of the other end of said supply passage;

said conduit means including a radially directed flow passage disposed adjacent the other end of said supply passage for providing flow communication between said supply passage and said discharge passage;

valve means including a movable valve body for controlling flow of fluid medium from said supply passage through said flow passage into said discharge passage;

said valve body comprising a sleeve-like valve member axially slidably and sealingly supported on said inner shaft-like member for axial shifting movement between an open position permitting flow through said flow passage and a closed position which substantially closes off said flow passage, said valve member having an exterior surface which is exposed to and acted on by the fluid medium in said supply passage so that said fluid medium continually urges said valve member into one of said positions; and electric coil means mounted on said conduit means for creating, when electrically energized, a magnetic field which moves said valve member into the other of said positions.

7. A device according to claim 6, wherein said valve member when in said open position is disposed axially between said inlet opening and said flow passage so that said supply passage extends around and axially along an exterior circumferential surface of said valve member, whereby fluid medium flows axially along said supply passage toward said flow passage and imposes an axially directed force on said valve member urging it toward said closed position.

8. A device according to claim 7, wherein said outer shaft-like member has an end wall which projects radially inwardly for terminating said supply passage at said other end, said inner shaft-like member having a free end which is spaced axially a small distance from said end wall so as to define said radially directed flow passage therebetween, said valve member being axially slidably supported on said inner shaft-like member adjacent the free end thereof, and said nozzle means being fixed to said end wall and projecting axially therefrom.

9. A device according to claim 8, wherein said inner shaft-like member is tubular and has said yarn passage formed axially therethrough, said nozzle means projecting coaxially into said inner shaft-like member in radially inwardly spaced relationship therefrom to define said discharge passage radially therebetween, said nozzle means comprising a tube-like member having an opening extending axially therethrough and through said end wall, said last-mentioned opening constituting an extension of said yarn passage.

10. A device according to claim 8, wherein said nozzle means comprises an elongate tube which is fixed to and projects axially outwardly from said end wall on the side thereof which is opposite from the position of said inner shaft-like member, said tube defining said discharge passage extending axially thereof and through said end wall for communication with said flow passage, said tube having a free end which projects into said yarn passage with said free end defining said discharge orifice for discharging therefrom a stream of fluid medium directed in a direction generally along said yarn passage.

11. A device according to claim 8, wherein said valve member has a small opening extending radially therethrough for permitting restricted flow of fluid medium therethrough into said discharge passage when the valve member is in said closed position.

12. A device according to claim 7, wherein said valve member has a small opening extending radially therethrough for permitting restricted flow of fluid medium therethrough into said discharge passage when the valve member is in said closed position.

13. A device according to claim 7, wherein the fluid medium solely effects movement of the valve member from its open position to its closed position.

* * * * *